US009175860B2

(12) United States Patent
Padilha et al.

(10) Patent No.: US 9,175,860 B2
(45) Date of Patent: Nov. 3, 2015

(54) SYSTEM OF SLIDING SHELVES FOR AN OVEN

(75) Inventors: Eramis Braz Padilha, Curitiba (BR); Allexandre Cesar Abib Brites, Curitiba (BR)

(73) Assignee: ELECTROLUX DO BRASIL S.A., Curitiba (BR)

( * ) Notice: Subject to any disclaimer, the term of this patent is extended or adjusted under 35 U.S.C. 154(b) by 470 days.

(21) Appl. No.: 13/585,069

(22) Filed: Aug. 14, 2012

(65) Prior Publication Data

US 2013/0042854 A1 Feb. 21, 2013

(30) Foreign Application Priority Data

Aug. 15, 2011 (BR) ..... PI1104204-4

(51) Int. Cl.
*F24C 15/16* (2006.01)
*A47B 88/06* (2006.01)

(52) U.S. Cl.
CPC ..... *F24C 15/162* (2013.01); *F24C 15/168* (2013.01)

(58) Field of Classification Search
CPC .... A47B 88/0014; A47B 88/10; A47B 63/02; A47B 88/06; F24C 15/16; F25D 23/012; E06B 3/4663; F25C 15/16
USPC ..... 126/339, 340
See application file for complete search history.

(56) References Cited

U.S. PATENT DOCUMENTS

| | | | | |
|---|---|---|---|---|
| 1,487,950 | A | 3/1924 | Kimmerle | |
| 1,885,404 | A | 3/1932 | Bamberg et al. | |
| 2,804,068 | A | 8/1957 | Miller et al. | |
| 3,016,276 | A | 1/1962 | Morse | |
| 3,830,220 | A | 8/1974 | Demetreon | |
| 4,637,373 | A | 1/1987 | Shirai et al. | |
| 5,586,817 | A * | 12/1996 | Hubbard et al. | 312/334.44 |
| 7,380,410 | B2 * | 6/2008 | Rand et al. | 62/302 |
| 2005/0217658 | A1 | 10/2005 | Sozo et al. | |
| 2010/0018517 | A1 | 1/2010 | Chen | |

FOREIGN PATENT DOCUMENTS

| | | |
|---|---|---|
| BR | PI0405488 | 8/2006 |
| BR | MU8601330 | 3/2008 |
| BR | MU8900649 | 11/2010 |
| BR | PI0905196 | 2/2011 |
| GB | 562323 | 6/1944 |
| WO | 2010132191 | 4/2010 |

* cited by examiner

*Primary Examiner* — Steven B McAllister
*Assistant Examiner* — Rabeeul Zuberi
(74) *Attorney, Agent, or Firm* — Pearne & Gordon LLP

(57) ABSTRACT

Systems of sliding shelves for ovens are provided. The system includes a lower shelf and an upper shelf. The lower shelf includes a vertical rod; and the upper shelf includes an engagement element, and a stop horizontally distant from said engagement element. The vertical rod of the lower shelf mechanically interacts with the engagement element and with the stop.

18 Claims, 4 Drawing Sheets

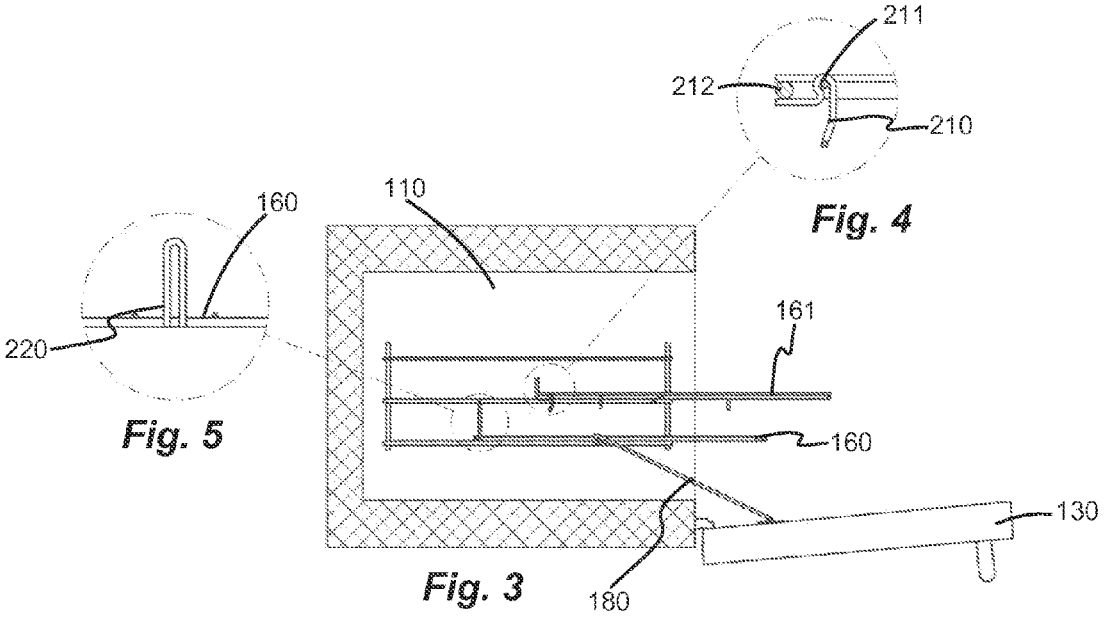
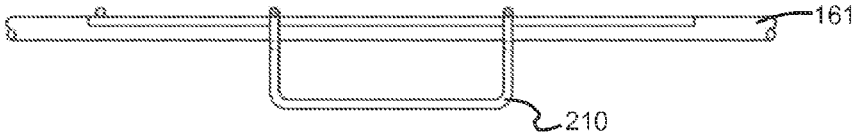
Fig. 6

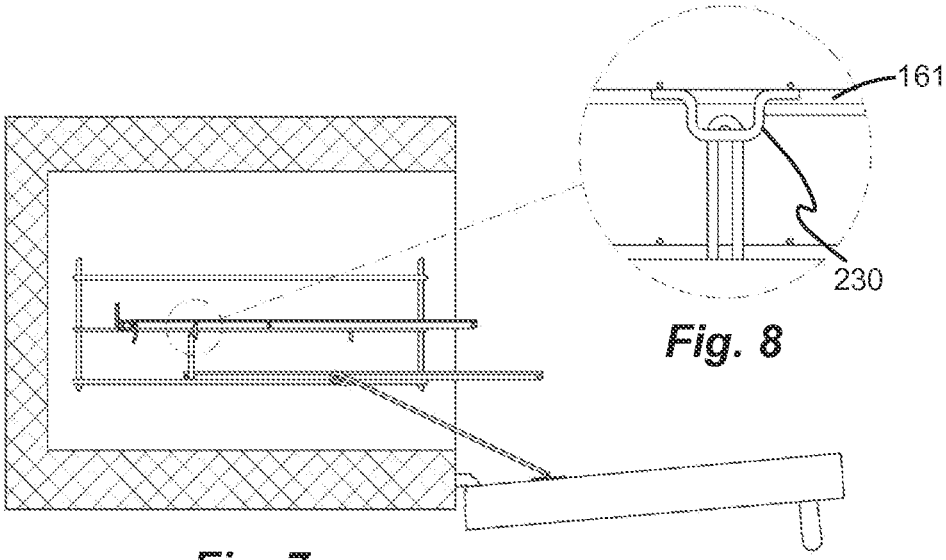
Fig. 8
Fig. 7
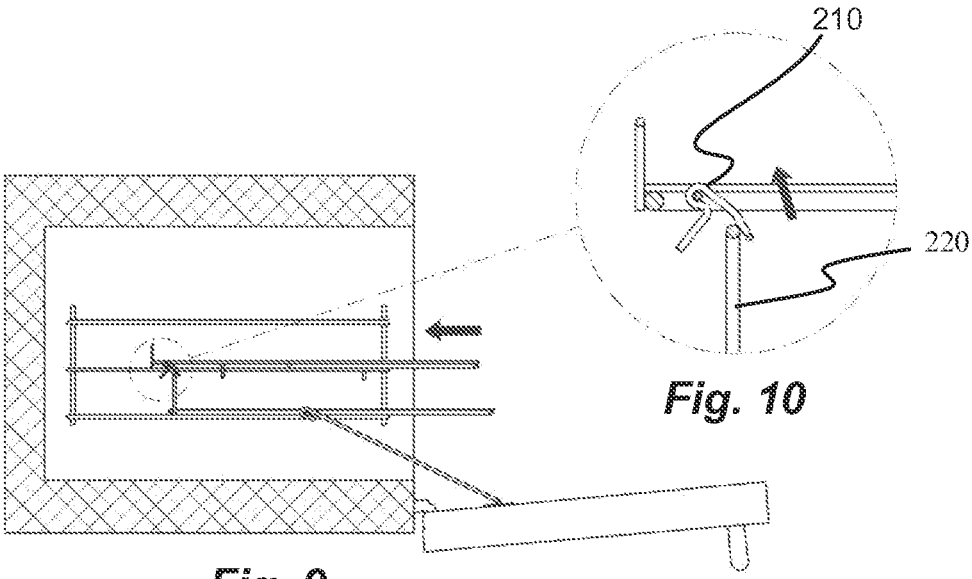
Fig. 10
Fig. 9

SYSTEM OF SLIDING SHELVES FOR AN OVEN

FIELD OF INVENTION

This invention relates generally to oven shelves and more particularly to sliding shelf systems for ovens.

BACKGROUND OF INVENTION

Ovens are household and/or industrial appliances that are well known and essential in preparing food. Both discrete ovens, those consisting essentially of a cooking cavity, and ovens combined with cooktops, that is, ranges incorporating one or more burners combined with an oven, the latter generally positioned beneath the cooktop, are known.

The cooking cavity of an oven is generally parallelepiped-shaped, having 5 fixed walls and on one side a removable wall, such as a door, through which access is gained to the inside of the cavity. The walls may also include thermal insulation to prevent the heat generated within the cavity from dissipating, as well as an aperture through which the gas and heat generated within the cavity can escape to offset the internal temperature and pressure.

Various sources of radiation may be used to generate heat within the oven cavity or directly on the food, including, but not limited to, gas burners, electrical resistors, microwave generation, heated steam, etc. A combination of more than one source of heat may also be used in a single oven, such as a gas oven with a heating resistor, a microwave oven with a heating resistor, etc.

Ovens may include one or more inner shelves serving both to support the food during cooking and to adjust the height of the food within the oven.

Numerous embodiments of oven shelves, generally consisting of metal wire forming a grill, are known to the art.

Oven shelves generally have sliding capability, that is, they are horizontally slidable within the oven cavity for ease of placement or removal of the food being cooked, which is normally contained in containers such as baking trays, pans, glass trays, etc.

Systems are also known to the art that couple the sliding of the shelf to the opening of the oven door. In other words, the shelves move horizontally outwardly from the oven cavity when the door is opened, and return to their original position within the oven cavity when the door is again closed.

DESCRIPTION OF INVENTION

The described system provides sliding shelves for an oven including: a lower shelf, and an upper shelf, wherein the lower shelf is provided with a vertical rod; and the lower shelf includes an engagement element and a stop horizontally distant from said engagement element, and said vertical rod of said lower shelf mechanically interacts with said engagement element and with said stop.

In additional or alternative embodiments, the system may further comprise the following characteristics, either singly or in combination: said vertical rod is of a height lesser than the vertical clearance separating the lower shelf from the upper shelf, yet sufficient to interact with said engagement element and with said stop; said engagement element includes a fixed lever pivotable around a shaft, having one end projecting downwardly in relation to the upper shelf and the other projecting horizontally and supported on a support point at the rear of the shelf; said engagement element is mounted directly on a cross wire of the shelf; said lower shelf is connected to the door of an oven, such that it moves horizontally and in unison with the opening and closing motion of the oven door; said system comprises more than two shelves.

In another embodiment, the system of sliding shelves for an oven comprises: a lower shelf, and an upper shelf, wherein the lower shelf is provided with a vertical rod and a pin removably fitted to said rod; and the lower shelf comprises an engagement element and a stop horizontally distant from said engagement element, said pin of said lower shelf mechanically interacting with said engagement element and with said stop.

In additional or alternative embodiments, the following characteristics may be present, either singly or in combination: said vertical rod is of a height lesser than the vertical clearance separating the lower shelf from the upper shelf and insufficient to mechanically interact with said engagement element and with said stop; said engagement element comprises a fixed lever pivotable around a shaft, having one end projecting downwardly in relation to the upper shelf and the other projecting horizontally and supported on a support point at the rear of the shelf; said engagement element is mounted directly on a cross wire of the shelf; said lower shelf is connected to the door of an oven, such that it moves horizontally and in unison with the opening and closing motion of the oven door; said system comprises more than two shelves.

BRIEF DESCRIPTION OF THE DRAWINGS

The sliding shelf system will now be described with respect to particular embodiments and with reference to the accompanying drawings, which are provided solely as examples of particular embodiments. The drawings are schematic and their dimensions and proportions may not reflect reality, being as they are intended merely to illustrate the system in a didactic manner, without imposing any limitations other than those defined in the claims further below. In the accompanying drawings:

FIG. 2 is a detail view of the shelf in FIG. 1;

FIG. 3 is a schematic, cross-sectional side view of a system of shelves in accordance with a first embodiment;

FIG. 4 is a cross-sectional view of the detail in FIG. 3, showing the engagement element of the upper shelf;

FIG. 5 is a rear view of the detail in FIG. 3, showing the vertical rod of the lower shelf;

FIG. 6 is a rear view of an upper shelf in accordance with one embodiment, showing the engagement element of the upper shelf;

FIG. 7 is a schematic, cross-sectional side view of the lower shelf mechanically interacting with the upper shelf stop;

FIG. 8 is a rear view of the detail in FIG. 7, showing the upper shelf stop;

FIG. 9 illustrates the mechanical interaction between the engagement element and the vertical rod;

FIG. 10 is a blown up view of the detail in FIG. 9;

DESCRIPTION OF PARTICULAR EMBODIMENTS OF THE INVENTION

In this description, the expression placing and removing "food" and another variants thereof refers to any object placed or removed into or from the oven cavity, including, but not necessarily, food or food contained in a container, such as a baking tray, pan, etc.

Likewise, the expression "mechanical interaction" and other variants thereof should be understood to mean interaction, even if partial, between one mechanical element and another, producing an outcome.

Figure 1:
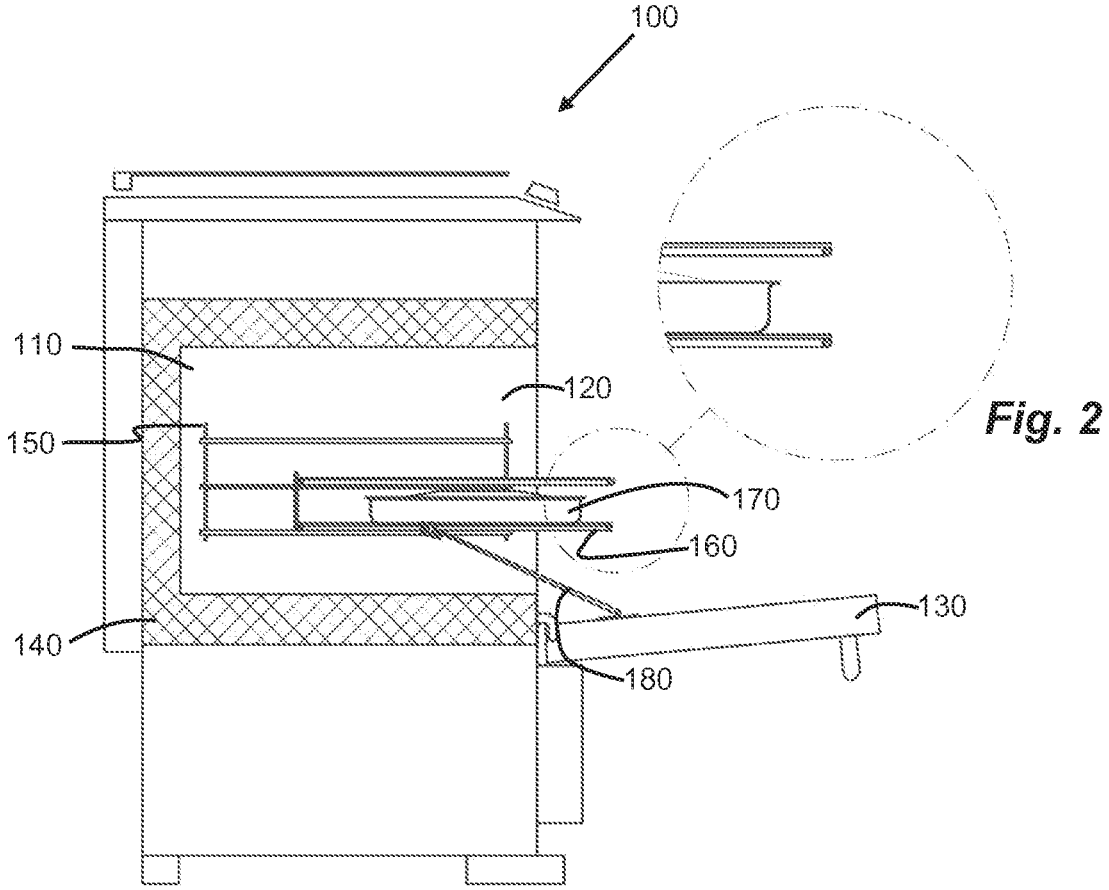
FIG. 1 is a schematic, cross-sectional side view of an oven with prior-art sliding shelves.

Referring first to FIGS. 1 and 2, an oven (100) is depicted comprising a cavity (110) and an opening (120) provided with a door (130) providing access to the inside of the cavity (110). The oven here schematically depicted is an oven incorporated in a range, but could, of course, be a discrete or industrial oven.

The oven cavity (110) is generally lined with an insulating material (140), such as fiberglass insulation lined with aluminium foil, and has rails (150) on which shelves are mounted to support the food (170) to be cooked within the cavity (110). This depiction illustrates two shelves, an upper shelf (161) and a lower shelf (160), but an oven may, of course, include more than two shelves. In embodiments known to the art, the lower shelf (160) is connected to the oven door (130) by rods (180), for example, as well as to the upper shelf (161). As can be seen, as the oven door (130) is opened, the angular motion of the door (130) is transmitted to the rod, which transforms said motion into linear motion, pulling the lower shelf (160) and, in turn, the upper shelf (161). However, in such prior-art embodiments, both the upper shelf (161) and the lower shelf (160) travel the same linear distance and are therefore aligned when the door (130) is opened. Inserting or removing food (170) may be made difficult by the small clearance between the shelves and, furthermore, the user may come in contact with a shelf and run the risk of being burned if the shelves remain hot.

Because a merely schematic depiction is shown in the figures, other elements of the oven, such as burners, other sources of radiation and internal lights, have been omitted for a better understanding of the system.

FIG. 3 is a schematic, cross-sectional side view of a system of sliding shelves for an oven, wherein the shelves are horizontally slidable in offset fashion, according to a first embodiment.

The lower shelf (160) may include a connection (180) to the oven door (130) so that the angular motion of the door (130) imparts linear motion to the lower shelf (160) in unison. Said connection may, for example, be a pivotable rod (180) having one end connected to the lower shelf (160) and the other to the oven door (130).

The lower shelf (160) can also include a vertical element that includes a vertical rod (220). Said vertical rod (220) has a height lesser than the clearance separating the lower shelf (160) from the upper shelf (161), yet sufficient to interact with an engagement element (210) and a stop (230) on the upper shelf (161), as will be made clearer further herein. The vertical rod (220) can be an elongated u-shaped wire member having its free ends secured to a side wire member of the lower shelf (160).

The upper shelf (161), in turn, should include an engagement element (210), particularly consisting of a hook-shaped wire member, or lever pivotable around a shaft (211). The engagement element (210) includes one end projecting downward and the other projecting horizontally. The pivot shaft (211) is provided on the same plane as the shelf, as can be better understood from FIGS. 3 to 5, 9 and 10. The engagement element (210) is supported, at the end projecting horizontally, on a supporting point (212) that may also consist of a wire of the shelf. Because oven shelves are generally made of metal wire, shaped in similar fashion to a grill, the engagement element (210) may be mounted directly to one of the cross wires of the shelf. The engagement element (210) is preferably of a width sufficient to interact with the vertical rod (220) of the lower shelf (160), as seen in FIG. 6. The upper shelf (161) further comprises a stop (230) projecting vertically toward the lower shelf (160) and of sufficient height to come in contact with the vertical rod (220) of the lower shelf (160). The stop (230) includes a u-shaped wire member with outwardly flanged ends that attached to a side wire member of the upper shelf (161). The longitudinal distance between the stop (230) and the engagement element (210) can be defined as the desired offset of the upper shelf (161) with respect to the lower shelf.

The system will now be described with respect to its operation, also in reference to the accompanying drawings.

When the upper shelf (161) is inserted into the oven, it slides into the cavity (110) and the engagement element (210) contacts the vertical rod (220) of the lower shelf (160). When this happens, the vertical rod (220) exerts resistance against the engagement element (210) due to the horizontal motion of inserting the shelf into the cavity (110). The engagement element (210), in turn, pivots counter clockwise around its fastening shaft (211), as seen in the accompanying drawings and particularly FIG. 10. Thus, the engagement element (210) is able to traverse the vertical shaft (220) without resistance and, after traversing the vertical shaft (220) of the lower shelf (160), it returns to its resting position, as shown in FIG. 7, and the upper shelf (161) can be completely inserted into the oven cavity (110). Hence, in operating mode the engagement element (210) is located to the rear of the vertical shaft (220) of the lower shelf (160).

When the oven door (130) is opened, the lower shelf (160) moves horizontally outwardly from the oven cavity (110) and its vertical shaft (220) contacts the stop (230) of the upper shelf (161). As can be observed, since the stop (230) of the upper shelf (161) is horizontally offset with respect to the rod of the lower shelf (160), the lower shelf (160) will travel a certain distance without moving the upper shelf (161). Only when the vertical rod (220) of the lower shelf (160) comes against the stop (230) of the upper shelf (161) does it then begin to "pull" the upper shelf (161) thereby maintaining an offset between the distance travelled by the lower shelf (160) and the upper shelf (161).

When the oven door (130) is closed, the lower shelf (160) begins to move horizontally in the reverse direction, that is, into the cavity (110). The upper shelf (161) remains motionless until the vertical rod (220) on the lower shelf (160) comes in contact with the engagement element (210) and, because the engagement element (210) is pivotable in only one direction of rotation (in the example depicted, only in the counter clockwise direction so that the upper shelf (161) can be easily inserted, as previously described), the rod of the lower shelf (160) encounters resistance from the engagement element (210) and "pushes" the lower shelf (160) in the same direction of travel into the cavity (110), until the oven door (130) is completely shut and the upper and lower shelves are aligned within the cavity (110).

The upper shelf (161) can be readily removed for cleaning, for example, by "lifting" the engagement element (210), that is, by causing it to pivot such that it will not come in contact with the vertical rod (220) of the lower shelf (160), and the upper shelf (161) can be removed without encountering resistance or requiring disassembly of additional elements.

Figures 11, 12:
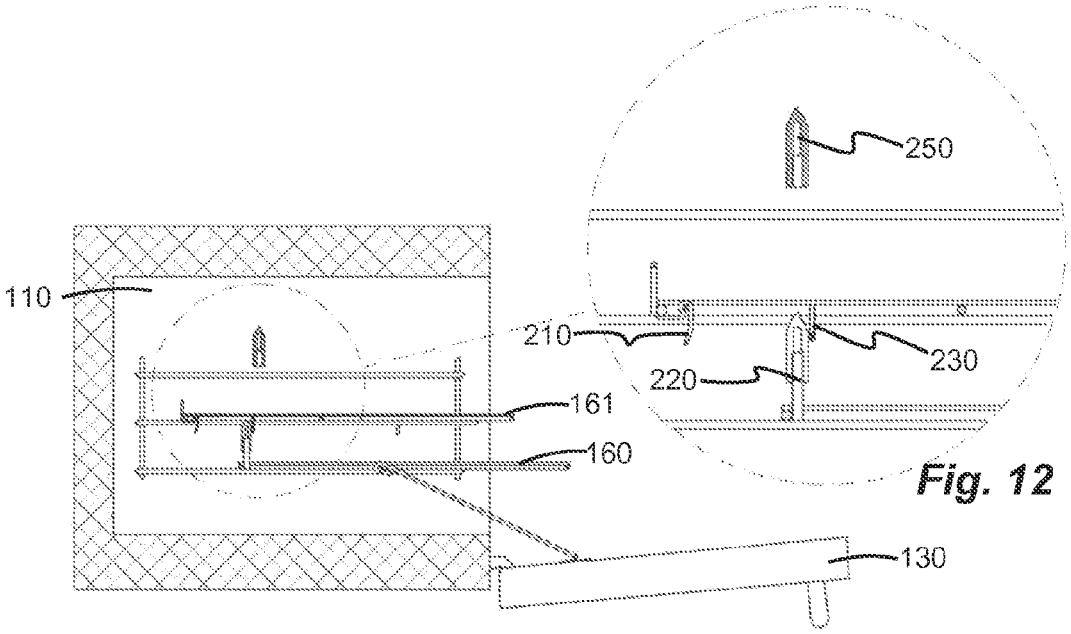
FIG. 11 is a schematic, cross-sectional side view of an alternative embodiment.
FIG. 12 is a view of the detail in FIG. 11.

In an alternative embodiment, as depicted in FIGS. 11 and 12, the vertical element on the lower shelf (160) includes a vertical rod (220) that is of a height lesser than a height of a downwardly projecting engagement element (210) and stop (230) of the upper shelf (161). In other words, the vertical rod is of a height insufficient to interact with the engagement element (210) or the stop (230) when the lower shelf (160) moves horizontally. This may be desirable if the user wishes not to use, or to "disable", the coordinated, offset motion of the upper shelf (161) in relation to the lower shelf (160). However, if the coordinated and offset motion of the two shelves is desired, the vertical element may also include a pin (250) that is fitted to the vertical rod (220) to increase its height and thereby enable mechanical interaction between the vertical rod to which the pin is attached and the engagement element (210) and stop (230) on the upper shelf (161). The operation of the system then proceeds as previously described.

As can be seen, an embodiment with a small number of parts is provided that is easily applicable in imparting offset horizontal motion to oven shelves, including shelves already existing.

Although the above-described embodiments exemplify an oven having two shelves, the system may naturally be applied to ovens containing three or more shelves by simply replicating the elements described herein, such as the vertical rod (220), the engagement element (210) and the stop (230), to the other shelves, it being also possible to establish a progressive offset between one shelf and the next by simply offsetting the stop(s) at progressive distances, as desired.

While this above has been described with respect to its preferred embodiments, those skilled in the art may make various changes of structure and form or expand the concepts described above to other applications not addressed in this description. The claims further below should therefore be interpreted as covering any and all equivalents thereof.

The invention claimed is:

1. A system of sliding shelves for an oven, comprising:
a lower shelf; and
an upper shelf,
wherein the lower shelf comprises a vertical element,
wherein the upper shelf comprises an engagement element and a stop, the stop being positioned horizontally distant from said engagement element,
wherein the vertical element of said lower shelf is configured to mechanically interact with said engagement element and with said stop,
wherein when the vertical element interacts with said stop, movement of the lower shelf causes the upper shelf to move, and
wherein the engagement element is pivotable such that when the vertical element engages with the engagement element from one direction, the engagement element pivots such that the engagement element traverses the vertical element and when the vertical element engages with the engagement element from an opposite direction, the engagement element's range of pivoting is limited such that the engagement element remains engaged with the vertical element.

2. The system of claim 1, wherein the vertical element further comprises a vertical rod having a height less than a vertical distance between the lower shelf and the upper shelf, but greater than a distance between the lower shelf and a bottommost portion of the stop.

3. The system of claim 1, wherein the engagement element comprises a lever and that can pivot around a shaft and extends, on one side, downwardly in relation to the upper shelf and, on the other side, extends horizontally and is supported on a support point.

4. The system of claim 1, wherein the engagement element is mounted directly on a cross wire of the upper shelf.

5. The system of claim 1, wherein the lower shelf is connected to the door of an oven, such that it moves horizontally and solidarily to the opening and closing movement of the door of the oven.

6. The system of claim 1, wherein the system comprises more than two shelves.

7. The system of claim 2, wherein the vertical rod extends upwardly from a side member of the lower rack and wherein the stop extends downwardly from a side member of the upper rack.

8. The system of claim 1, wherein the lower shelf is not directly connected to the upper shelf.

9. A system of sliding shelves for an oven, comprising:
A lower shelf; and
An upper shelf;
The lower shelf comprising a vertical element that further comprises a vertical rod extending therefrom and a pin removable positioned on said vertical rod; and
The upper shelf comprises an engagement element and a stop horizontally distant from said engagement element, and said pin of said lower shelf mechanically interacts with said engagement element and with said stop, and wherein when said pin is removed said vertical element does not interact with said engagement element or said stop.

10. The system of claim 9, wherein the vertical rod comprises a height less than the vertical distance between the lower shelf and the upper shelf and the height is insufficient to interact mechanically with said engagement element and said stop.

11. The system of claim 9, wherein the engagement element comprises a lever and that can pivot around a shaft and extends, on one side, downwardly in relation to the upper shelf and, on the other side, extends horizontally and is supported on a support point.

12. The system of claim 9, wherein the engagement element is mounted directly on a cross wire of the upper shelf.

13. The system of claim 9, wherein the lower shelf is connected to the door of an oven, such that it moves horizontally and solidarily to the opening and closing movement of the door of the oven.

14. The system of claim 9, wherein the system comprises more than two shelves.

15. The system of claim 9, wherein the lower shelf is not directly connected to the upper shelf.

16. The system of claim 9, wherein the engagement element is configured to pivot when contacted by the vertical element in a first direction, and wherein the engagement element is configured to not pivot when contacted by the vertical element in a second direction.

17. The system of claim 1, wherein the vertical element has a height less than a vertical distance between the lower shelf and the upper shelf, but greater than a distance between the lower shelf and a bottommost portion of the stop.

18. The system of claim 17, wherein the vertical element extends upwardly from a side member of the lower rack and wherein the stop extends downwardly from a side member of the upper rack.

* * * * *